US006532710B2

(12) United States Patent
Terry

(10) Patent No.: US 6,532,710 B2
(45) Date of Patent: Mar. 18, 2003

(54) SOLID MONOLITHIC CONCRETE INSULATED WALL SYSTEM

(76) Inventor: Leonard R. Terry, 2116 Blue Iris Place, Longwood, FL (US) 32779-3014

( * ) Notice: Subject to any disclaimer, the term of this patent is extended or adjusted under 35 U.S.C. 154(b) by 0 days.

(21) Appl. No.: 09/776,551

(22) Filed: Feb. 2, 2001

(65) Prior Publication Data

US 2001/0032425 A1 Oct. 25, 2001

Related U.S. Application Data

(60) Provisional application No. 60/180,121, filed on Feb. 3, 2000.

(51) Int. Cl.[7] ..... E04D 1/04

(52) U.S. Cl. ..... 52/561; 52/283; 52/381; 52/405.3; 52/425

(58) Field of Search ..... 52/283, 284, 381, 52/405.3, 405.1, 425, 432, 561, 309.12

(56) References Cited

U.S. PATENT DOCUMENTS 3,750,355 A * 8/1973 Blum ..... 52/309.12
4,053,677 A * 10/1977 Corao ..... 52/309.12 X
4,125,981 A * 11/1978 MacLeod et al. ..... 52/309.12
4,334,394 A * 6/1982 Mader ..... 52/309.12
4,669,240 A * 6/1987 Amormino ..... 52/236.6
4,998,393 A * 3/1991 Baena ..... 52/236.9
6,119,422 A * 9/2000 Clear et al. ..... 52/309.8
6,305,135 B1 * 10/2001 Inaba ..... 52/309.12

* cited by examiner

*Primary Examiner*—Yvonne M. Horton
*Assistant Examiner*—Brian E. Glessner

(57) ABSTRACT

This invention is a building technique with multiple applications that addresses many known needs in a vast marketplace that far surpasses existing technology. Energy savings alone is an extremely important worldwide issue that has not been addressed by other building techniques today, as it should have been. Today, Americans are dependent upon the radical and unstable oil producing nations for our energy. This trend is unwise and extremely dangerous to the peace of our nation. Measures must be taken now to slow down the depletion of natural energy resources. This process is a cutting edge, innovative technological building system that produces the highest energy efficiency in addition to fire protection, termite protection, moisture protection, sound resistance and wind resistance possible at a cost comparable to wood, block or steel construction. The inventor's life long mission has been to create the highest possible building quality for the least possible cost without sacrificing architectural ambiance. This invention addresses all of the natural disasters and man made disasters facing our world today. Marketing potentials exist in new residential and commercial construction, construction of safe room home additions and remodeling additions. Other marketing potentials exist through the Internet in the areas of franchising building techniques to builders and the marketing of an information report to consumers reflecting ideas of effective building techniques to potential homebuyers worldwide.

6 Claims, 3 Drawing Sheets

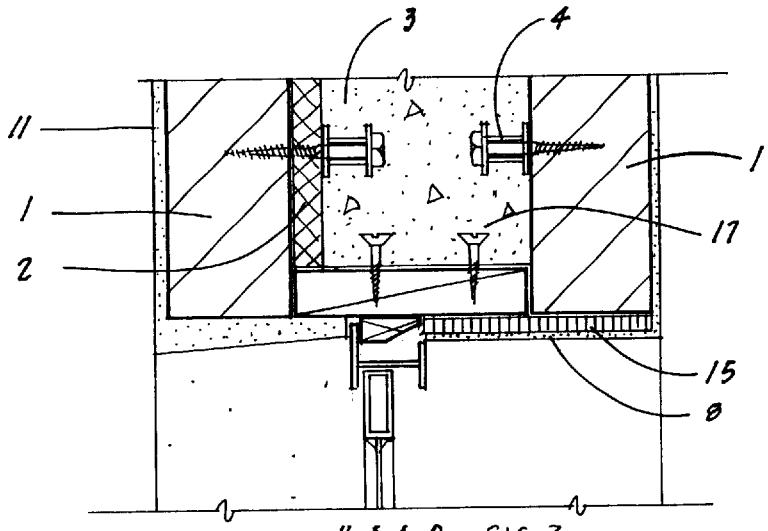
HEAD - FIG. 3
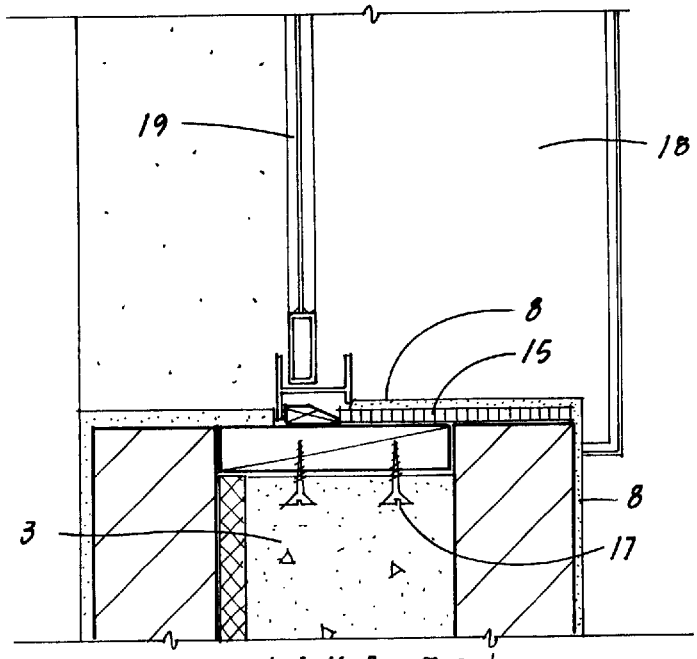
JAMB - FIG 4
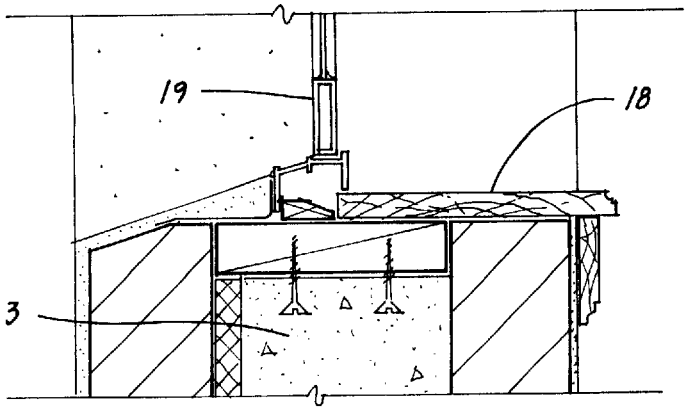
SILL - FIG 5

SOLID MONOLITHIC CONCRETE INSULATED WALL SYSTEM

CROSS-REFERENCE TO RELATED OPERATIONS

This application claims priority to provisional application No. 60/180,121 filed on Feb. 3, 2000.

STATEMENT REGARDING FEDERALLY SPONSORED RESEARCH

Not Applicable

REFERENCE TO A MICROFICHE APPENDIX

Not Applicable

BACKGROUND OF THE INVENTION

The field of endeavor of this invention, is the process consisting of a highly energy efficient, fire retardant, wind resistant, termite proof, moisture resistant and burglar resistant exterior wall system used in the construction of residential and commercial buildings. The exterior wall system is created by pouring concrete between two "stay in place" autoclaved aerated concrete (known as AAC; lightweight concrete) forming walls. This process creates a solid, steal reinforced, monolithic concrete wall system around the entire parameter of the building structure. The interior walls are made from AAC materials. This wall system would normally be more expensive than a conventional exterior wall. However, since the interior walls are made from a porous material (AAC), only a skim coat of plaster is required and the expense of furring strips, drywall and taping of drywall joints are totally eliminated. The elimination of drywall labor and materials will totally offset the expense of the more elaborate and thick outside wall system contained in this process. The process of this invention is unique and never before were three types of concrete delivered on the job site and constructed in this manor. The total cost of construction using this invention is equal to or slightly less than conventional construction made from block, wood or steel.

Many systems have been invented and patented which claim to strengthen the structural integrity of wall systems to achieve various benefits such as wind resistance to protect against damaging hurricanes and tornadoes and energy efficiency. They all use a POLYSTYRENE material in forming or for insulation. The following patents reflect such Each of the above inventions addresses certain problems in either the construction environment, the construction process or a certain benefit for the user of the end product. This invention however addresses all the environmental burdens caused by nature and man that are placed on constructed buildings.

Since most patented processes contain POLYSTYRENE called STYROFOAM in the forming and insulation process the fire hazard and workability is significantly hampered. The additional labor and workmanship required to work with the STYROFOAM causes increased construction costs and a less than environmentally safe building. STYROFOAM when exposed to heat caused by fire, burns (without flame) and gives off a toxic black smoke. This will breach the integrity of the building and making it unsafe for the occupants during a fire.

This invention seals all non-structural and protective components such as vapor barriers and STYROFOAM insulation inside the concrete wall cavity. This will keep non-structural building materials away from the harsh elements of the environment on the outside, and away from the occupants on the inside. Additionally, job site workmanship is easier and less expensive since tradesmen do not have to work with unstructural materials such as STYROFOAM while attaching their materials to the structure. For examples the electricians do not have to cut STYROFOAM away in order to attach to the structural wall behind the STYROFOAM. Everything in the interior and exterior walls are made from 100% concrete. This invention addresses a process to finally erect a cost effective, total straight and level concrete structure. All systems that were examined, contained conventional drywall inside the building. This invention contains absolutely no drywall, which will lower the construction cost and totally offset the cost of building the exterior wall system that is reflected in this invention.

BRIEF SUMMARY OF THE INVENTION

Since it's existence, the construction industry has been only concerned with making a profit in an extremely competitive industry. Additionally, intellectual expansion of better construction methods and materials has been stymied by the ignorance of the consumer and the willingness of the consumer to want more luxury now instead of energy savings or safety in the future. Safety has never been a perceived issue since it has always been an assumption that additional safety costs additional money. The consumer most often desired more luxury items then the extra cost of conservation of energy and safety. Using this invention, the consumer can have energy conservation and safety for the same price as conventional construction. Most consumers are only concerned with energy conservation and safety to the extent that it costs them money. This invention now offers these benefits without additional construction costs.

Rapid escalation of energy costs, dependency on unstable regions of the world for our energy needs, hurricane Andrew that leveled parts of South Florida in 1992, the tornadoes that visited Central Florida and killed over 40 people and caused countless millions of dollars in damage in 1998, the major threat to the Florida coastline during hurricane Floyd in September of 1999, and the fire storms that damaged or destroyed hundreds of homes in 1985 and again in mid 1998, are just a few of the reasons for alarming concern which caused the inventor to seek solutions. Building owners are gradually realizing that the age-old adage that "it won't happen to me" is fading fast! Other needs that have been materializing in recent decades is the wood destroying infestation such as termites, mold and mildew, moisture. Even home invasion is grabbing the attention of many of the worlds inhabitants.

After all, man's attempts to control the elements of our atmosphere have been feeble at best. As stated above, incidents of violent storms have been on the rise with the resulting increase in loss of life and property. According to the National Weather Bureau, storms in our future will be record breaking in numbers and intensity. Also, according to Dr. Kevin Trenberth of the National Center for Atmospheric Research, major swings of atmospheric conditions causing firestorms due to prolonged droughts, destructive hurricanes and tornadoes, and deep freezes in the Northern US will be a norm in the years and decades to come. Other construction concerns, especially in the Florida environment, are increases of termite infestation; strands of termites that can penetrate all types of construction, moisture and mildew problems, and fires caused by neglect and firestorms, home invasion, and increasing energy costs. The inventor was inspired to investigate and study in detail, each of these areas of concern and has applied learned knowledge to each concern developing an inexpensive but very comprehensive solution for each area of concern. There is no doubt about the fact that buildings are being built today with unparalleled lack of quality due to man's desire to cut costs in this competitive crazed market. Everything, including man's safety, and wasting of precious fossil fuels, has boiled down to money! The inventor has discovered new ways to drastically increase the strength, quality, and durability of buildings and at the same time creates a healthier atmosphere in buildings and achieves comparable conventional construction costs. A vision realized, planned and applied!

All patented systems here to for, are complicated, expensive and not practical from the standpoint of solving the forces of nature. This invention addresses the energy crisis, fire storm potential caused by drought and man's neglect, wind damage caused by hurricanes and tornadoes, burglars and home invaders, moisture problems, wood rot, and damage caused by termites and other wood destroying insects. Never before has a process been so intense, comprehensive and creative in solving known problems in today's changing world.

BRIEF DESCRIPTION OF THE SEVERAL VIEWS OF THE DRAWINGS

FIG. 3—Shows the window head or top side view.

FIG. 4—Shows the window jamb or bottom top view.

FIG. 5—Shows the windowsill or bottom side view.

DETAILED DESCRIPTION OF THE INVENTION

Figure 1:
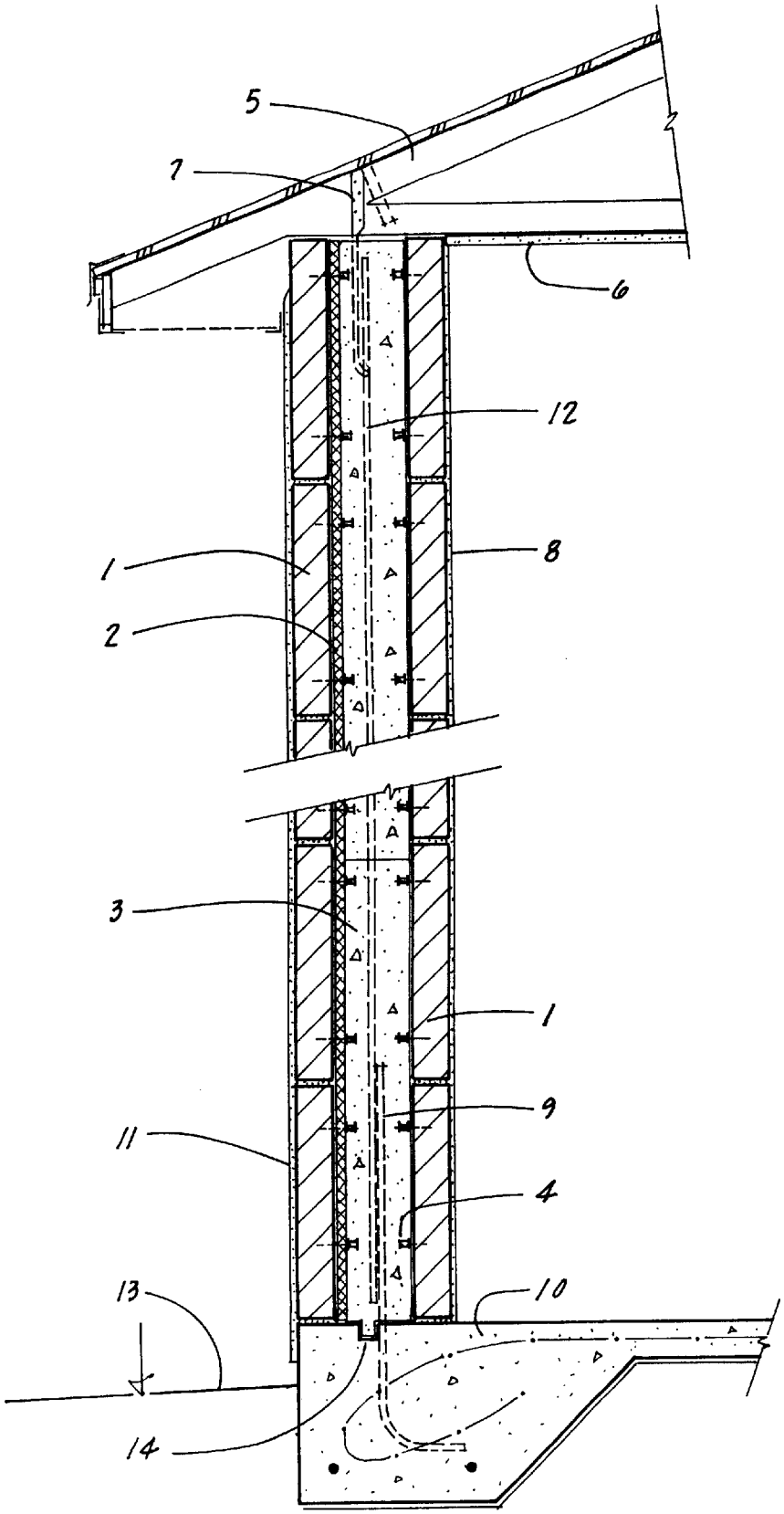
FIG. 1—Shows the cut away side view of the wall system, roof, roof ties and slab.

The invention consists of 100% concrete construction on interior walls, exterior walls and ceilings of buildings. Building materials consist of 2 types of concrete arriving at the job site in 3 forms as follows:

1. Conventional Concrete—A solid core, which is made of solid steal reinforced conventional concrete poured "in place" on the job site. The concrete consist of a 3,000 PSI mixture, containing fiber and a special bonding and hardening agent, which is poured inside a cavity between two stay in place forming walls 1 completely around the perimeter of the building. This creates a 100% monolithic wall system with no seams or joints around the entire perimeter of the building.
2. Lightweight Concrete—A highly cellular, lightweight material from quartzite, lime and water, known as Autoclaved Aerated Concrete (AAC) which is used as a "stay in place" forming system of the exterior walls 1 land interior walls 1. AAC is delivered to the job site in "block" form directly from the manufacturer. AAC is available from 5 local manufactures in the Southeastern United States.
3. Conventional Concrete Board—Conventional concrete in sheet form (8' by 4' sheets called DUROCK) delivered to the job site from a material supplier.

Two AAC 4 inch walls 1 are placed 5.25 inches apart and run the entire perimeter of the respective building. The two walls 1 are designed to form a cavity in which the concrete 3 is poured. Anchor bolts 4, which are bolted deep into each side of the walls 1, hang into the cavity. These anchor bolts 4 have a large washer connected to the end of the anchor that extends into the cavity approximately 1.5 inches. Then 3,000 pound per square inch concrete 3, containing fiber and plastersizer is poured into the cavity which surrounds the steel reinforcement rods 9, 12 and the anchor bolts 4. This structurally connects the two AAC walls 1 to the steel reinforced concrete center 3. AAC is a finish wall on the inside and outside of the wall system. There is no furring strips or drywall in the entire construction process. The savings of not having to use drywall materials and drywall labor will offset the additional cost of the sophisticated exterior wall system.

For insulation purposes two sheets of foil backed insulation 2 are attached to the inside of the outside wall by the anchor bolts 4 containing large washers which hold the insulation 2 in place until the concrete 3 is poured in place. The insulation ratings on each insulation sheet 2 have a very high "R" factor and each AAC wall has a high insulation factor as well. The completed exterior system has an insulation rating much greater than any available construction technique used today. For moisture protection, a thick layer of plastic 16 is placed between the insulation 2 and the outside exterior wall 1.

The finished product has a vapor barrier 16, extremely high insulation capacity and a 100% complete monolithic wall structure with nothing exposed but the fire rated and "finish" material of AAC The total thickness of the wall system is 13.25 inches. Therefore, this wall system protects against fire, termites, moisture, wind, energy inefficiency and burglaries. The vapor barrier 16 and the insulation 2 are buried deep inside the wall system and cannot burn, rot or decay over time. The wall system will be used for new home construction, "safe" room addition to existing homes, commercial applications and "health" home air protection environment. This invention consists of a combination of several building materials and building techniques that have never been placed together in any construction method. As mentioned above one of the building materials used in the invention is a lightweight concrete called Autoclaved Aerated Concrete known as "AAC." AAC is a building material that has the properties of wood, but without the disadvantages of combustibility, decay, moisture and termite damage. AAC is a highly cellular, lightweight material from quartzite, lime and water. It is marketed in 28 countries covering four continents. Availability of AAC will allow the invention process opportunity of going worldwide. Environmentally friendly and energy conserving, AAC meets all the requirements of our modem age. Absolutely no pollutants or hazardous wastes are generated in the production process, nor is there any wastage of precious raw materials. A house built with AAC is certified by the American Lung Association as a "Health House." Some advantages are workability, excellent thermal insulation, great acoustic insulation, fire resistance, and termite resistance. AAC used as part of the inventors wall systems of special steel reinforced solid concrete "core," moisture barrier, internal wall insulation, hurricane shutters, high impact windows, doors, roofs and the special method of construction, gives the invention process a very distinct advantage over conventional construction methods. Market potentials exist in new residential and commercial construction, safe room additions, builder franchise packages and homeowner information kits sold through the Internet.

Another proprietary part of this invention is how the windows 19 and frames are installed. In FIG. 3 of the drawing section, pressure treated 2×6's are slipped flush into the wall between the two A.A.C walls. On the cavity side of the wood, screws 17 are attached with the heads protruding into the cavity. After the concrete is poured the heads of the screws 17 are imbedded into the solid concrete core 3. On the outside of the wood concrete board DUROCK is attached, which completely covers the pressure treated wood. The windows 19 are then attached on top of the concrete board completely sealing the only wood in the exterior wall structure.

Figure 2:
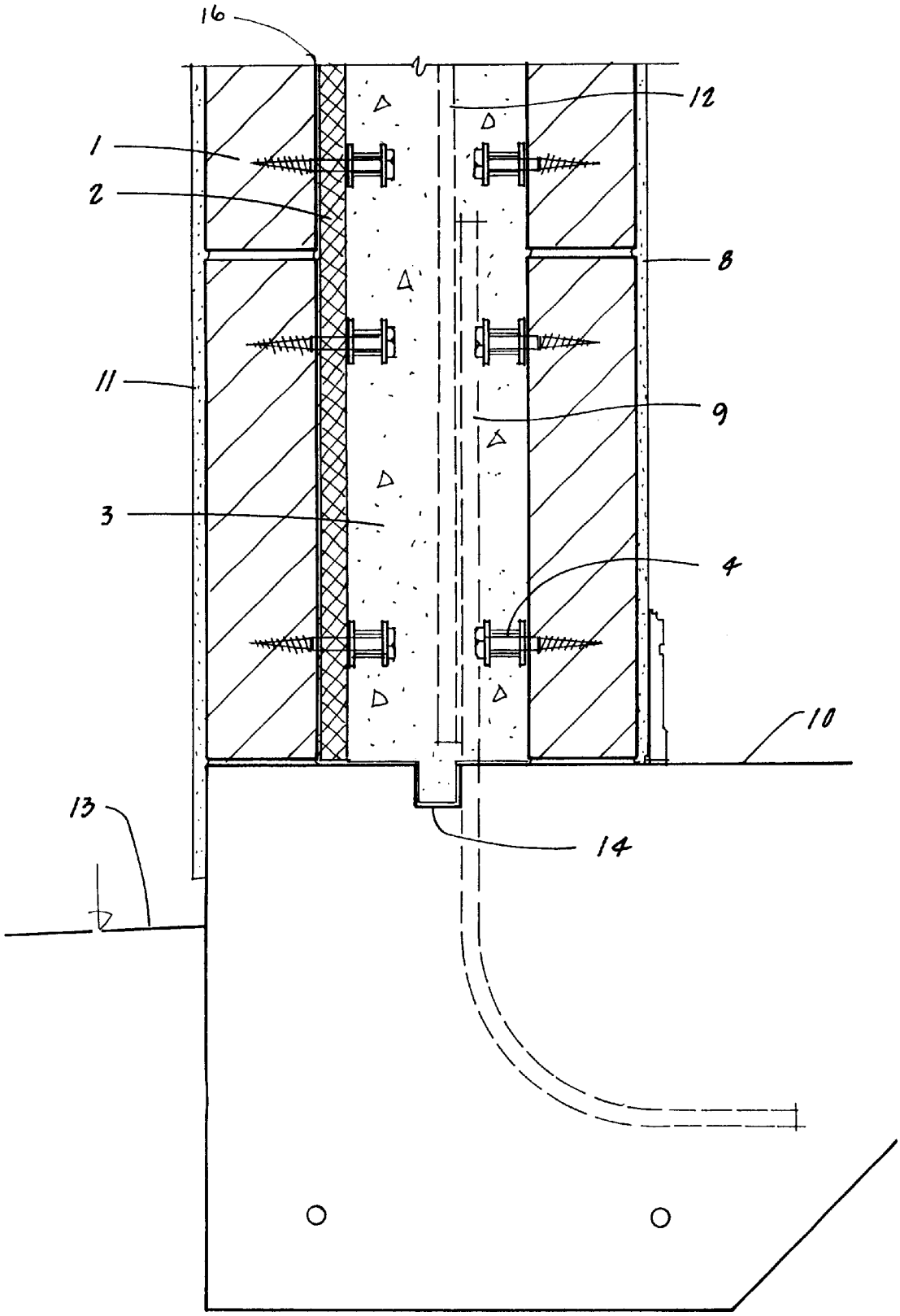
FIG. 2—Shows the larger view of the wall, slab and reinforcement rods (Re-Bar).

Another proprietary part of this invention is the interior core anchor bolts 4 that connects the two outer AAC walls to the solid concrete core. The anchor bolts 4 on the outside MC wall is longer than the anchor bolt 4 on the inside AAC wall. The extra length is needed to extend through the foil back insulation 2 that is attached to the inside of the outer AAC wall (see FIG. 2 in the drawing section). These bolts 4 have large washers that hang into the cavity and attach to the solid concrete core 3 after the pour.

Another proprietary part of this invention is the placement of the electrical, phone and central vacuum utilities onto the exterior walls. All exterior wall utilities are run through a conduit which runs up the middle of the concrete core through a hole placed in the inside exterior AAC wall. This conduit is placed in the cavity prior to pouring the concrete 3 into the cavity. Pulling of wires for utilities is much easier than with other concrete wall systems.

Another proprietary part of this invention is the exact order of the placement of the forming walls 1 without temporary bracing. All other forming systems require expensive bracing systems to hold the forms from movement while the concrete is being poured. This process requires no bracing since the AAC product is a substantial wall that will not move during pouring. A technique used in this process is building and pouring the wall height four feet at a time. This will absolutely prevent any movement of the forming walls. Moreover, plastersizer which is a chemical that promotes slump (liquidity) in the concrete without adding additional water and promotes rapid hardening time. The process is to build both forming walls four feet high. Then, starting at a point going around the cavity and pouring two feet at a time until the entire perimeter is completed. By the time the pour is back to the starting point the concrete will be hard enough to withstand another two feet of concrete on top of the first two feet. The fresh concrete 3 will be poured down against the hard concrete and have an affect of pushing down and not out against the AAC forming walls. Putting it another way, the first pour is now connected to the AAC walls by the anchor bolts 4 making the first two feet of the wall one unit, therefore reducing the pressure against the forming walls on the next two feet. The weight of the new concrete will push down more than out against the forms. After two days of drying time the balance of the forming wall height is completed and the steel 9, 12 is placed into the cavity along with the extension of the utility conduit. Approximately one week from the first two foot pour, the wall cavity will be ready to accept the balance of the concrete 3.

Specially designed anchor bolts 4 that connect all three layers of the wall system together are connected from the inside of the wall cavity. This is done by a logical process of altering the forming wall construction in such a way as to allow the anchors 4 to be inside the cavity. See FIG. 2 on the drawing section. The outside wall 1 is erected first. Then the anchors 4 are attached through the vapor barrier 16 and the foiled insulation 2. Next the interior wall 1 is erected with the anchor bolts 4 already attached. The continuous vapor barrier 16 is draped over the outer wall 1 until the second stage wall construction is done allowing a continuous vapor seal 16. At the end of each width section of the vapor barrier 16 there will be a six to eight inch overlap. Two foil backed insulation pieces 2 are placed together with the foil sides out. One side will touch the concrete 3 and the other will touch the vapor barrier 16. This will have a much greater affect on the vapor protection and protect the insulation 2 from the wet concrete 3 during the pour. The A.A.C wall construction does not contain the vapor barrier principals since the construction process contains no vapor barriers or insulation inside the wall.

Not Applicable

All mechanical tradesmen have far less difficulty dealing with a solid mass of Autoclaved Aerated Concrete than they do dealing with flexible, spongy STYROFOAM. Electrical boxes on plugs and light switches are much easier to install onto AAC then soft STYROFOAM. AAC is a building material that has the properties of wood whereby the tradesman can saw, nail and screw into the AAC like they would with a wood product. All exterior wall utilities are run through conduit, which runs up the middle of the concrete core through a hole placed in the interior AAC wall.

AAC provides a fire rating of 6 plus hours for an 8-inch wall. This invention's walls are 13.35 inches thick, which will extend the rating significantly longer then 6 hours. This exceptional rating exceeds even the most stringent requirement of the Standard Building Code. The interior 4-inch AAC wall used in this invention, achieves a rating of 3 hours. These fire ratings were a test of Ytong-block and wall panels according to ASTM E 119 Standard Test Methods for Fire Testing of Building Construction Materials. Never before has a home been designed to be fire retardant on the inside as well as the outside. Roofing materials are AAC panels. Metal studs are used for the trusses and the soffits and all doors are metal. Even the baseboards and moldings are concrete. All paint is fire rated paint.

The high surface mass coupled with the mechanical vibration energy damping within the three layers of materials produces a construction material with exceptional sound insulation properties. The S.T.C. rating for a typical AAC 8 inch wall is rated at 53 according to Ytong (one manufacture of AAC) studies. The effect of two separate AAC 4 inch walls with a 5.25-inch solid concrete core would yield a much higher S.T.C. rating.

This process creates the least waste of precious raw materials such as wood and plastics than any other construction process. The only wood used is around doors and windows that are buried inside the wall system. This process is the most environmentally friendly and energy conserving and meets all the requirements of our modern age far beyond any other construction process. The forming wall system and the core materials, are a mineral based building material, made from sand, water and limestone. Absolutely no pollutants or hazardous waste is generated in the production process and there is no waste of precious raw materials such as wood and plastics.

This process contains the highest wind resistance of any other building technique on the market today. The standard 5.25 inch solid concrete is rated at a 250 miles per hour wind resistance. Ytong products, a manufacture of AAC, rates its resistance at 200 miles per hour. This process contains the thickness of BOTH wall systems. Since this process would increase the wind resistance far in excess of 250 miles per hour it can be concluded that this process is stronger than any other known building system being used today.

Specially designed anchor bolts 4 that connect all three layers of the wall system together are connected from the inside of the wall cavity, which no other building system contains. This is done by a logical process of altering the forming wall construction in such a way as to allow the anchors 4 to be inside the cavity. See FIG. 2 on the drawing section. The outside wall 1 is erected first; then the anchors 4 are attached through the vapor barrier 16 and the foiled insulation 2. Next the interior wall 1 is erected with the anchor bolts 4 already attached. The continuous vapor barrier 16 is draped over the outer wall 1 until the second stage wall construction is done allowing a continuous vapor seal. At the end of each width section of the vapor barrier 16 there will be a six to eight inch overlap. Two foil backed insulation pieces 2 are placed together with the foil sides out. One side will touch the concrete 3 and the other will touch the vapor barrier 16. This will have a much greater affect on the vapor protection and protect the insulation 2 from the wet concrete 3 during the pour.

What is claimed is:

1. A wall system comprising:

a first wall and a second wall spaced from the first wall a distance so as to form a cavity between the first and second walls;

a vapor barrier;

an insulation layer;

steel reinforcement rods;

concrete; and anchor bolts having extensions, wherein the anchor bolts are located on said first and second walls;

wherein the first wall and second wall are each comprised of a plurality of solid rectangular autoclaved aerated lightweight concrete blocks, said blocks are located in a stacked arrangement and held together with a tile glue, said blocks do not contain wire mesh so that they may be easily cut, said blocks are also light enough so that they are capable of being assembled without the need for a crane or other lifting device, said vapor barrier is located in said cavity adjacent to said first wall, said insulation layer is a foil backed insulation that does not comprise polystyrene and is located adjacent a side of the vapor barrier that is opposite the first wall, said anchor bolts on said first wall are located through said foil backed insulation, said vapor barrier, and partially into said blocks of said first wall so that the extensions of the anchor bolts are located in the cavity between the first and second walls and hold the foil backed insulation and the vapor barrier in place, said anchor bolts on said second wall are placed partially into the blocks of the second wall so that the extensions of the anchor bolts are located in the cavity between the first and second walls, said steel reinforcement rods are located in the center of the cavity, said cavity is filled with the concrete so that the extensions of the anchor bolts are embedded in said concrete and the first and second walls are held together only by said concrete, the wall system is fire resistant, termite resistant, energy efficient, sound resistant, moisture resistant, wind resistant, terrorist resistant, and ecologically beneficial.

2. A method of assembling the wall system of claim 1 comprising the steps of:

placing the blocks of the first wall on top of each other and placing the tile glue between adjacent blocks;

placing the vapor barrier adjacent to the first wall of blocks, placing the foil backed insulation adjacent to the vapor barrier on the side of the vapor barrier that is opposite to the first wall, placing the anchor bolts through the foil backed insulation, vapor barrier, and blocks so that the extensions of the anchor bolts protrude a distance from the foil backed insulation, placing the anchor bolts in the blocks to be used for the second wall so that the extensions of the anchor bolts protrude from a surface of the blocks used for the second wall, placing the blocks used for the second wall on top of each other and placing the tile glue between the adjacent blocks to form the second wall a spaced apart distance from the first wall so that the cavity is formed between the first wall and second wall, and the vapor barrier, the foil backed insulation, and the extensions of the anchor bolts are located within the cavity, placing the steel reinforcement in the center of the cavity, and pouring concrete in the cavity so that the heads of the anchor bolts are embedded in said concrete and hold the first and second wall together when the concrete sets.

3. The method of assembling the wall system of claim 2, further comprising the step of placing roof straps into the concrete at the top of the wall where a roof truss is to be placed when the concrete hardens.

4. The method of assembling the wall system of claim 2, further comprising the step of arranging the blocks to form door and window openings.

5. The method of assembling the wall system of claim 2, further comprising the step of placing a conduit in the center of the cavity for running electrical wires and phone lines.

6. The method of assembling the wall system of claim 2, further comprising the step of attaching finish materials to an outer surface of the first and second walls.

* * * * *